US011627409B1

(12) United States Patent
Pu et al.

(10) Patent No.: US 11,627,409 B1
(45) Date of Patent: Apr. 11, 2023

(54) EARPHONE DEVICE

(71) Applicant: Merry Electronics(Shenzhen) Co., Ltd., ShenZhen (CN)

(72) Inventors: Chih Ching Pu, Taichung (TW); Yi Lin Hsieh, Taichung (TW)

(73) Assignee: Merry Electronics(Shenzhen) Co., Ltd., ShenZhen (CN)

( * ) Notice: Subject to any disclaimer, the term of this patent is extended or adjusted under 35 U.S.C. 154(b) by 0 days.

(21) Appl. No.: 17/577,343

(22) Filed: Jan. 17, 2022

(30) Foreign Application Priority Data

Dec. 2, 2021 (TW) ..... 110144947

(51) Int. Cl.
*H04R 1/28* (2006.01)
*H04R 1/10* (2006.01)

(52) U.S. Cl.
CPC ..... *H04R 1/2896* (2013.01); *H04R 1/1016* (2013.01); *H04R 1/1075* (2013.01); *H04R 2400/11* (2013.01)

(58) Field of Classification Search
CPC .. H04R 1/2896; H04R 1/1016; H04R 1/1075; H04R 2400/11
See application file for complete search history.

(56) References Cited

U.S. PATENT DOCUMENTS 4,854,415 A * 8/1989 Goschke ..... H04R 25/60 381/328
10,863,292 B2 * 12/2020 Flaig ..... H04R 25/604
2008/0112584 A1 * 5/2008 Karamuk ..... H04R 25/604 381/324

* cited by examiner

*Primary Examiner* — Brian Ensey
(74) *Attorney, Agent, or Firm* — JCIPRNET

(57) ABSTRACT

An earphone device including a casing, a holder, a speaker, multiple first buffering members, and multiple second buffering members is provided. The casing has an inner wall forming a first chamber. A sound outlet tube protrudes from a front end of the casing. The holder is disposed in the first chamber, and has an inner surface and an outer surface. The inner surface of the holder forms a second chamber. The second chamber is acoustically connected to the sound outlet tube. The first buffering members are disposed between the inner surface of the holder and the speaker, forming a first gap between the inner surface of the holder and the speaker. The second buffering members are disposed between the outer surface of the holder and the inner wall of the casing, forming a second gap between the outer surface of the holder and the inner wall of the casing.

8 Claims, 5 Drawing Sheets

EARPHONE DEVICE

CROSS-REFERENCE TO RELATED APPLICATION

This application claims the priority benefit of Taiwanese application serial no. 110144947, filed on Dec. 2, 2021. The entirety of the above-mentioned patent application is hereby incorporated by reference herein and made a part of this specification.

BACKGROUND

Technical Field

The disclosure relates to an electronic device, in particular to an earphone device.

Description of Related Art

With the continuous progress of technology, in order to facilitate users to listen to sound information, earphone device has gradually become a necessary accessory. Moreover, earphone device provides better sound transmission for listeners to clearly hear and understand the content of the sound. However, at present, the earphone device emits sound through the speaker, and the vibration generated by the speaker will be directly transmitted to the casing of the earphone device, thus affecting the sound quality of the earphone device. Therefore, how to improve the vibration problem in the earphone device so that the sound transmitted by the earphone device has good quality is an issue to work on.

SUMMARY

The disclosure provides an earphone device capable of reducing vibration transmitted from a speaker to a casing and having a good sound quality.

An earphone device of the disclosure includes a casing, a holder, a speaker, multiple first buffering members, and multiple second buffering members. The casing has an inner wall. The inner wall forms a first chamber. A sound outlet tube protrudes from a front end of the casing. The sound outlet tube is acoustically connected to the first chamber. The holder is disposed in the first chamber of the casing. The holder is defined as having an inner surface and an outer surface. The inner surface of the holder forms a second chamber. The second chamber is acoustically connected to the sound outlet tube of the casing. The speaker is disposed in the second chamber of the holder. The first buffering members are disposed between the inner surface of the holder and the speaker, forming a first gap between the inner surface of the holder and the speaker. The second buffering members are disposed between the outer surface of the holder and the inner wall of the casing, forming a second gap between the outer surface of the holder and the inner wall of the casing.

According to an embodiment of the disclosure, a bearing end is near the front end of the casing and the sound outlet tube. The bearing end is configured to bear an end of the holder. The end of the holder has an opening. Part of the speaker protrudes from the opening of the holder and is connected to the sound outlet tube.

According to an embodiment of the disclosure, an elastic member is disposed on the end of the holder. The elastic member is resting against the bearing end of the casing. Hardness of the elastic member is less than hardness of the holder.

According to an embodiment of the disclosure, hardness of the holder is greater than hardness of the first buffering members and hardness of the second buffering members.

According to an embodiment of the disclosure, each of the second buffering members includes a supporting part and a stress-dispersing part corresponding to the supporting part. The supporting part and the stress-dispersing part are disposed in a same axial direction. Each of the supporting parts protrudes outward from the outer surface of the holder, and the stress-dispersing part corresponding to the supporting part is located between the supporting part and the inner wall of the casing.

According to an embodiment of the disclosure, the each of the supporting parts includes a first supporting layer and a second supporting layer corresponding to the first supporting layer. The first supporting layer and the second supporting layer are disposed in a same axial direction. Each of the first supporting layers protrudes outward from the outer surface of the holder. The second supporting layer corresponding to the first supporting layer is located between the first supporting layer and the stress-dispersing part. Hardness of the second supporting layer is greater than hardness of the first supporting layer. Hardness of the first supporting layer is greater than hardness of the stress-dispersing part.

According to an embodiment of the disclosure, the earphone device further includes a fixing member. The fixing part is disposed in the sound outlet tube. The fixing member fixes part of the speaker.

According to an embodiment of the disclosure, hardness of the fixing member is less than hardness of the sound outlet tube.

Based on the above, in the earphone device of the disclosure, since the holder is in contact with the speaker and the casing through the first buffering members and the second buffering members respectively, the holder may not be in direct contact with the speaker and the casing. In a conventional earphone device, a holder is wrapped around to fix a speaker, making the vibration generated by the speaker directly transmitted to the holder and a casing, which affects the rest of the components in the casing and destroys the sound quality output by the earphone device. Accordingly, compared with conventional earphone device, the earphone device of the disclosure may be provided with the first buffering members and the second buffering members, that is, to reduce the contact between the holder and the speaker and the casing, to improve transmission of the vibration of the speaker and to avoid affecting the other components in the casing, so that the headphone device may output sound with good quality.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
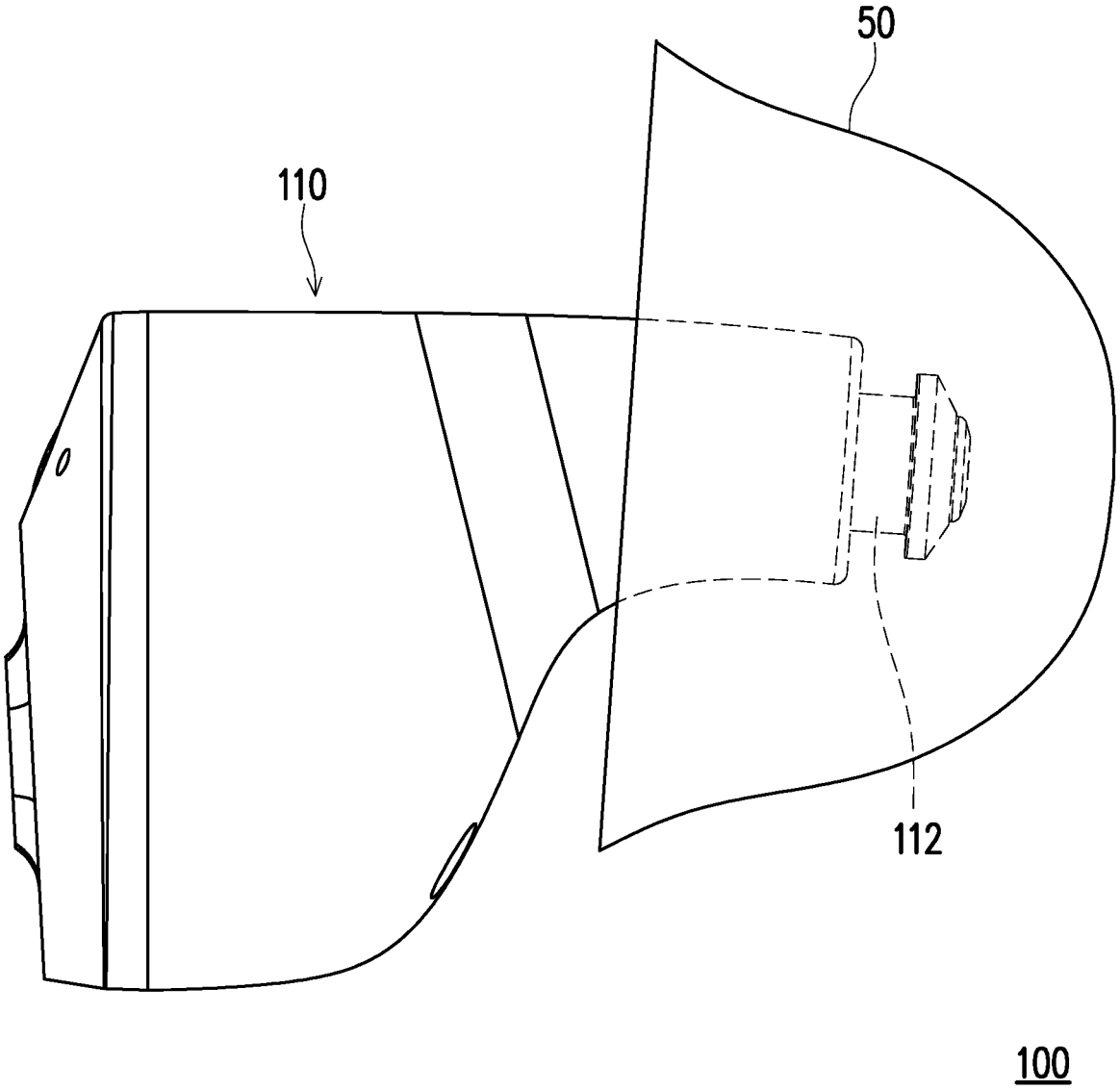
FIG. 1 is a side view of an earphone device according to an embodiment of the disclosure.
Figure 2A:
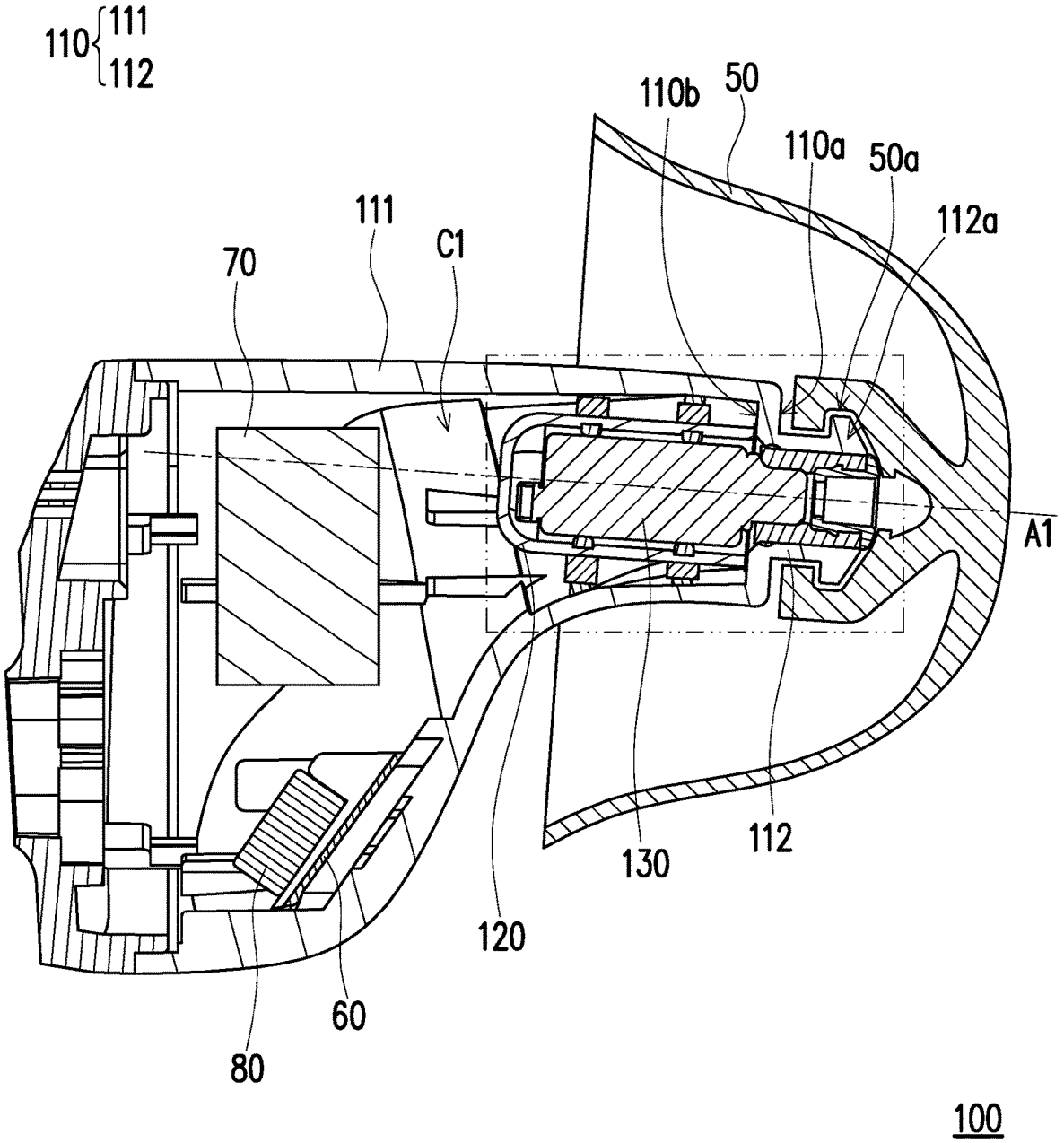
FIG. 2A is a cross-sectional view of the earphone device of FIG. 1.
Figure 2B:
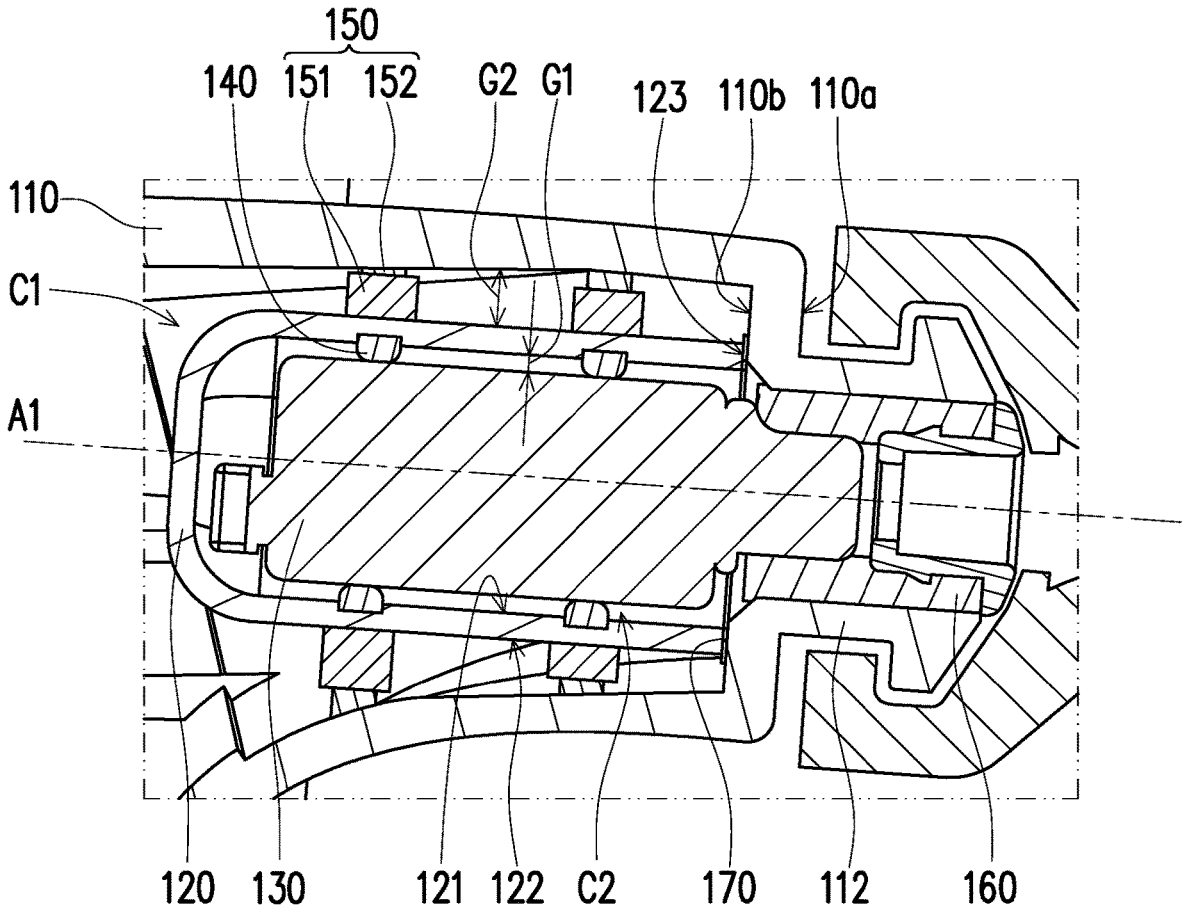
FIG. 2B is a partial enlarged view of the earphone device of FIG. 2A.
Figure 3:
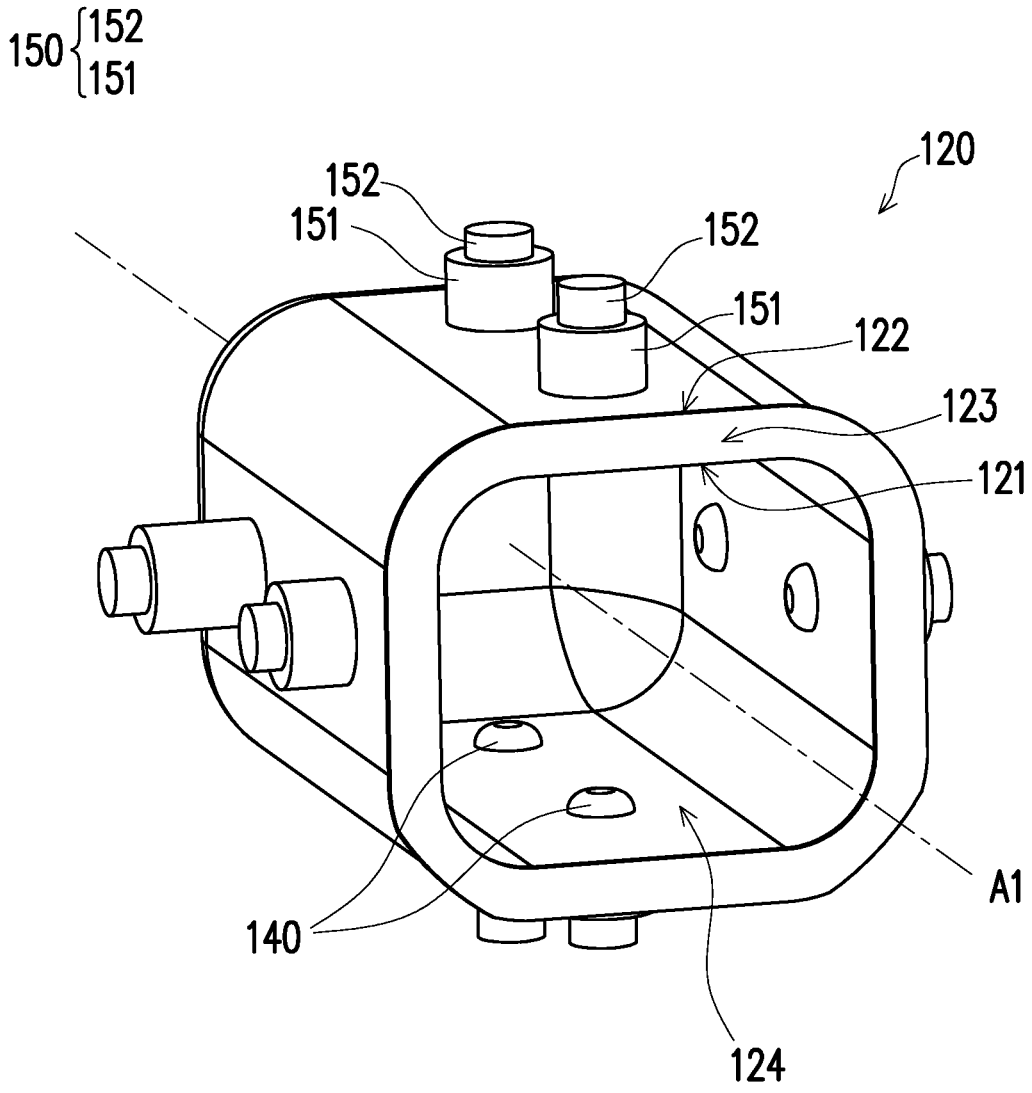
FIG. 3 is a three dimensional view of a holder, multiple first buffering members, and multiple second buffering members of the earphone device of FIG. 2B.

FIG. 1 is a side view of an earphone device according to an embodiment of the disclosure. FIG. 2A is a cross-sectional view of the earphone device of FIG. 1. FIG. 2B is a partial enlarged view of the earphone device of FIG. 2A. FIG. 3 is a three dimensional view of a holder, multiple first buffering members, and multiple second buffering members of the earphone device of FIG. 2B. It should be noted that in order to clearly represent the structure of the casing 110, part of the casing 110 in FIG. 1 is shown in dashed lines.

Referring to FIG. 1 and FIG. 2A at the same time, an earphone device 100 according to this embodiment includes an earplug 50, a microphone 80, a battery module 70, an audio processing module 60, a casing 110, a holder 120, and a speaker 130. The earplug 50 is assembled outside the casing 110, and the microphone 80, the battery module 70, the audio processing module 60, the holder 120, and the speaker 130 are respectively disposed in the casing 110.

Referring to FIG. 2A, according to this embodiment, the casing 110 has an inner wall 111, and the inner wall 111 forms a first chamber C1. A sound outlet tube 112 protrudes from a front end 110*a* of the casing 110 along an extension direction A1 of the casing 110, and is acoustically connected to the first chamber C1. A side of the sound outlet tube 112 relative to the front end 110*a* of the casing 110 has a snap-on convex 112*a* for fixing a snap-on concave 50*a* of the earplug 50.

Referring to FIG. 2B, according to this embodiment, the holder 120 is disposed in the first chamber C1 of the casing 110, is defined as having an inner surface 121 and an outer surface 122, and the inner surface 121 of the holder 120 forms a second chamber C2. The speaker 130 is disposed in the second chamber C2 of the holder 120, so that sound generated by the speaker 130 may be directed by the sound outlet tube.

In detail, referring to FIG. 2B and be 112 of the casing 110. FIG. 3 at the same time, according to this embodiment, the earphone device 100 includes multiple first buffering members 140 and multiple second buffering members 150. The first buffering members 140 are respectively disposed between the inner surface 121 of the holder 120 and the speaker 130, forming a first gap G1 between the inner surface 121 of the holder 120 and the speaker 130. The second buffering members 150 are respectively disposed between the outer surface 122 of the holder 120 and the inner wall 111 of the casing 110, forming a second gap G2 between the outer surface 122 of the holder 120 and the inner wall 111 of the casing 110.

Here, it should be noted that according to this embodiment, hardness of the holder 120 is greater than hardness of the first buffering member 140 and the second buffering member 150, so that the holder 120 has sufficient strength to support the speaker 130 and is firmly fixed to the inner wall 111 of the casing 110, but not limited thereto.

According to one embodiment, the holder 120 is made of metal, for example, and may prevent the sound generated by vibration of the speaker 130 from being transmitted to the casing 110, but not limited thereto. According to one embodiment, a material of the first buffering member 140 and a material of the second buffering member 150 are, for example, thermoplastic elastomers that can absorb part of the vibration generated by the speaker 130, but not limited thereto. According to one embodiment, an extension direction of the first buffering member 140 and an extension direction of the second buffering member 150 are disposed in a same axial direction, but not limited thereto. According to other embodiments, the extension direction of the first buffering member 140 and the extension direction of the second buffering member 150 are not disposed in the same axial direction, but not limited thereto.

It should be noted that in the earphone device 100 according to this embodiment, since the holder 120 is in contact with the speaker 130 and the casing 110 through the first buffering members 140 and the second buffering members 150 respectively, the holder 120 may not be in direct contact with the speaker 130 and the casing 110.

Compared with conventional earphone device, the earphone device 100 of the disclosure may reduce the contact between the holder 120 and the speaker 130 and the casing 110 by disposing the first buffering members 140 and the second buffering members 150 to improve transmission of the vibration of the speaker 130 and to avoid affecting the other components in the casing 110, so that the headphone device 100 may output sound with good quality.

The following further explains the earphone device 100.

Referring to FIG. 2B and FIG. 3 at the same time, according to this embodiment, a bearing end 110*b* is near the front end 110*a* of the casing 110 and the sound outlet tube 112. The bearing end 110*b* is configured to bear an end 123 of the holder 120. The end 123 of the holder 120 has an opening 124 (shown in FIG. 3), and part of the speaker 130 protrudes from the opening 124 of the holder 120 and is connected to the sound outlet tube 112, so that the casing 110, the holder 120, and the speaker 130 together form the second chamber C2.

In detail, referring to FIG. 2B, according to this embodiment, the earphone device 100 further includes a fixing member 160 and an elastic member 170. The fixing member 160 is disposed in the sound outlet tube 112, and the fixing member 160 fixes part of the speaker 130. The elastic member 170 is disposed on the end 123 of the holder 120, and the elastic member 170 is resting against the bearing end 110*b* of the casing 110.

It should be noted here that according to this embodiment, hardness of the fixing member 160 is less than hardness of the sound outlet tube 112 to enable the fixing member 160 to clamp the speaker 130, and to avoid condition that the speaker 130 is in direct contact with the casing 110 and the vibration of the speaker 130 is transmitted directly to the casing 110. According to this embodiment, hardness of the elastic member 170 is less than the hardness of the holder 120, which may avoid the direct contact between the holder 120 and the casing 110, and the transmission of the vibration of the speaker 130 to the casing 110.

According to one embodiment, a material of the fixing member 160 is rubber, for example, to absorb part of the vibration generated by the speaker 130 while clamping the speaker 130, but not limited thereto. According to one embodiment, a material of the elastic member 170 is rubber, for example, to prevent the transmission of the vibration generated by the speaker 130 to the casing 110 through the holder 120, but not limited thereto.

Referring to FIG. 2B and FIG. 3 at the same time, according to this embodiment, each of the second buffering members 150 includes a supporting part 151 and a stress-dispersing part 152 corresponding to the supporting part 151. The supporting part 151 and the stress-dispersing part 152 are disposed in a same axial direction. Each of the supporting parts 151 protrudes outward from the outer surface 122 of the holder 120, and the stress-dispersing part 152 corresponding to the supporting part 151 is located between the supporting part 151 and the inner wall 111 of the casing 110.

It should be noted that hardness of the supporting parts 151 is, for example, greater than hardness of the stress-dispersing parts 152, so that the holder 120 has sufficient structural strength to firmly fix the holder 120 itself and the speaker 130 to the inner wall 111 of the casing 110, but not limited thereto. According to one embodiment, the supporting parts 151 are, for example, integrally formed on the outer surface 122 of the holder 120, but not limited thereto.

It should be noted here that the following embodiments follow the component designations and parts of the preceding embodiments, in which the same designations are used to indicate the same or similar components, and the description of the same technical content is omitted. The description of the omitted parts can be referred to the preceding embodiments, and therefore will not be repeated in the following.

Figure 4:
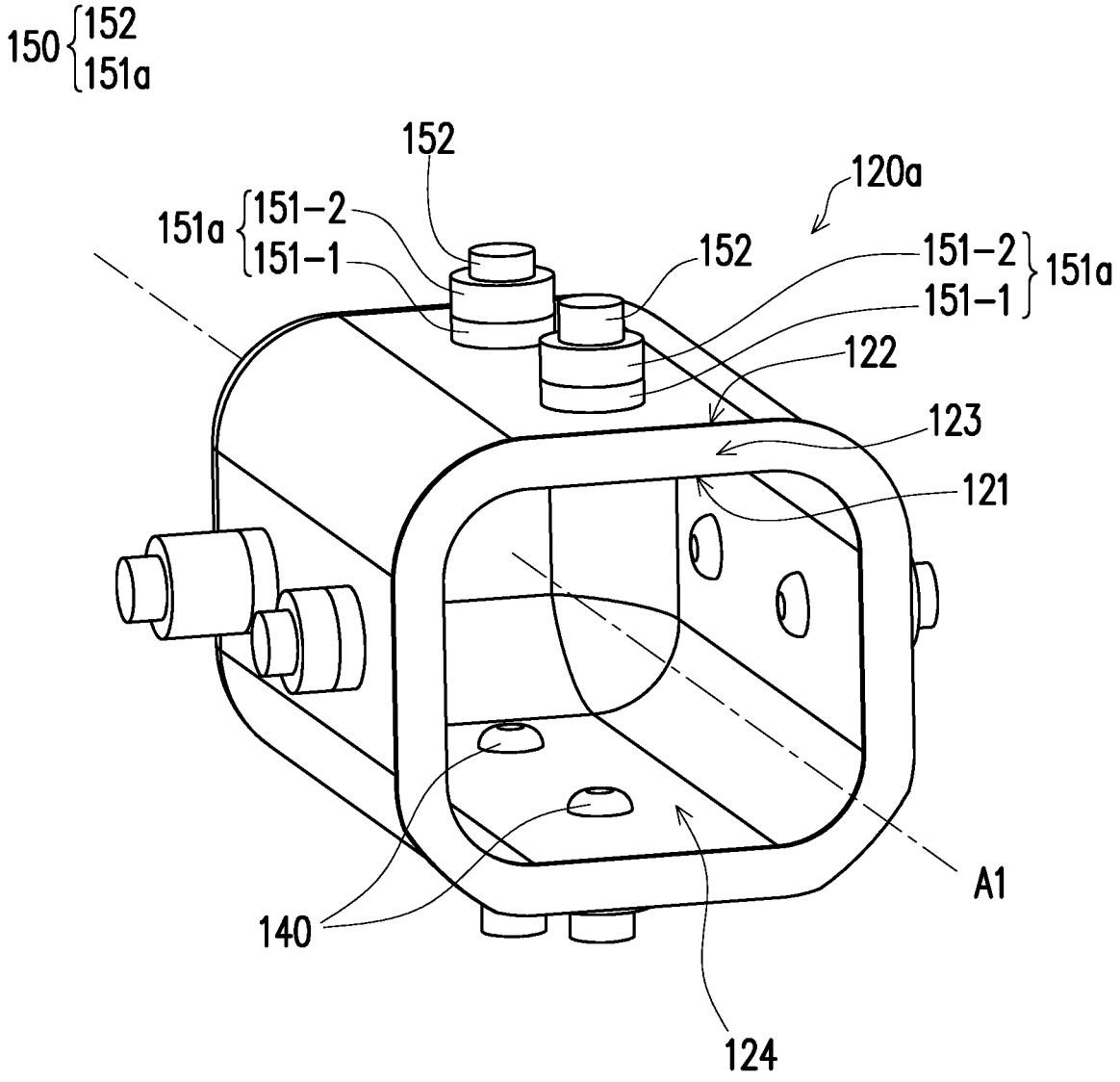
FIG. 4 is a three dimensional view of a holder, multiple first buffering members, and multiple second buffering members of an earphone device according to another embodiment of the disclosure.

FIG. 4 is a three dimensional view of a holder, multiple first buffering members, and multiple second buffering members of an earphone device according to another embodiment of the disclosure. Referring to FIG. 3 and FIG. 4 at the same time, a holder 120*a* according to this embodiment is similar to the holder 120 of FIG. 3, with the difference that the structure of a supporting part 151*a*.

Referring to FIG. 4, according to this embodiment, each of the supporting parts 151*a* includes a first supporting layer 151-1 and a second supporting layer 151-2 corresponding to the first supporting layer 151-1. The first supporting layer 151-1 and the second supporting layer 151-2 are disposed in a same axial direction. Each of the first supporting layers 151-1 protrudes outward from the outer surface 122 of the holder 120*a*, and is located between the holder 120*a* and the second supporting layer 151-2. The second supporting layer 151-2 corresponding to the first supporting layer 151-1 is located between the first supporting layer 151-1 and the stress-dispersing part 152. Here, it should be noted that, according to one embodiment, a material of the first supporting layer 151-1 is, for example, polyurethane (PU), but not limited thereto. According to one embodiment, the second supporting layer 151-2 is, for example, made of metal, but not limited thereto.

In detail, according to this embodiment, hardness of the second supporting layer 151-2 is greater than hardness of the first supporting layer 151-1, and the hardness of the first supporting layer 151-1 is greater than hardness of the stress-dispersing part 152, and the above structure allows the vibration generated by the speaker 130 to have a stress dispersion effect on the holder 120*a*, and causes the vibration of the speaker 130 to decay.

In summary, in the earphone device of the disclosure, since the holder is in contact with the speaker and the casing through the first buffering members and the second buffering members respectively, the holder may not be in direct contact with the speaker and the casing. In a conventional earphone device, a holder is wrapped around to fix a speaker, making the vibration generated by the speaker directly transmitted to the holder and a casing, which affects the rest of the components in the casing and destroys the sound quality output by the earphone device. Accordingly, compared with conventional earphone device, the earphone device of the disclosure may be provided with the first buffering members and the second buffering members, that is, to reduce the contact between the holder and the speaker and the casing, to improve transmission of the vibration of the speaker and to avoid affecting the other components in the casing, so that the headphone device may output sound with good quality.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. An earphone device comprising:

a casing having an inner wall, wherein the inner wall forms a first chamber, a sound outlet tube protrudes from a front end of the casing, and the sound outlet tube is acoustically connected to the first chamber;

a holder disposed in the first chamber of the casing, wherein the holder is defined as having an inner surface and an outer surface, the inner surface of the holder forms a second chamber, and the second chamber is acoustically connected to the sound outlet tube of the casing;

a speaker disposed in the second chamber of the holder;

a plurality of first buffering members disposed between the inner surface of the holder and the speaker, forming a first gap between the inner surface of the holder and the speaker; and a plurality of second buffering members disposed between the outer surface of the holder and the inner wall of the casing, forming a second gap between the outer surface of the holder and the inner wall of the casing.

2. The earphone device according to claim 1, wherein a bearing end is near the front end of the casing and the sound outlet tube, the bearing end is configured to bear an end of the holder, the end of the holder has an opening, and part of the speaker protrudes from the opening of the holder and is connected to the sound outlet tube.

3. The earphone device according to claim 2, wherein an elastic member is disposed on the end of the holder, the elastic member is resting against the bearing end of the casing, and hardness of the elastic member is less than hardness of the holder.

4. The earphone device according to claim 1, wherein hardness of the holder is greater than hardness of the first buffering members and hardness of the second buffering members.

5. The earphone device according to claim 1, wherein each of the second buffering members comprises a supporting part and a stress-dispersing part corresponding to the supporting part, the supporting part and the stress-dispersing part are disposed in a same axial direction, each of the supporting parts protrudes outward from the outer surface of the holder, and the stress-dispersing part corresponding to the supporting part is located between the supporting part and the inner wall of the casing.

6. The earphone device according to claim 5, wherein the each of the supporting parts comprises a first supporting layer and a second supporting layer corresponding to the first supporting layer, the first supporting layer and the second supporting layer are disposed in a same axial direction, each of the first supporting layers protrudes outward from the outer surface of the holder, the second supporting layer corresponding to the first supporting layer is located between the first supporting layer and the stress-dispersing part, hardness of the second supporting layer is greater than hardness of the first supporting layer, and hardness of the first supporting layer is greater than hardness of the stress-dispersing part.

7. The earphone device according to claim 1 further comprising a fixing member, wherein the fixing member is disposed in the sound outlet tube, and the fixing member fixes part of the speaker.

8. The earphone device according to claim 7, wherein hardness of the fixing member is less than hardness of the sound outlet tube.

* * * * *